US010118780B2

(12) United States Patent
Ishida et al.

(10) Patent No.: US 10,118,780 B2
(45) Date of Patent: Nov. 6, 2018

(54) SHEET TRANSFER GUIDE, IMAGE FORMING APPARATUS INCORPORATING THE SHEET TRANSFER GUIDE, AND IMAGE READING DEVICE INCORPORATING THE SHEET TRANSFER GUIDE

(71) Applicants: Masahiro Ishida, Kanagawa (JP); Toshiaki Takahashi, Tokyo (JP)

(72) Inventors: Masahiro Ishida, Kanagawa (JP); Toshiaki Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/615,304

(22) Filed: Jun. 6, 2017

(65) Prior Publication Data

US 2017/0357190 A1 Dec. 14, 2017

(30) Foreign Application Priority Data

Jun. 9, 2016 (JP) ..... 2016-115298

(51) Int. Cl.

| | |
|---|---|
| ***B65H 3/66*** | (2006.01) |
| ***B65H 29/52*** | (2006.01) |
| ***B65H 5/38*** | (2006.01) |
| ***B65H 3/06*** | (2006.01) |

(52) U.S. Cl.

CPC ..... *B65H 3/66* (2013.01); *B65H 5/38* (2013.01); *B65H 29/52* (2013.01); *B65H 3/0607* (2013.01); *B65H 2404/522* (2013.01); *B65H 2404/5211* (2013.01); *B65H 2404/531* (2013.01); *B65H 2404/5521* (2013.01); *B65H 2404/612* (2013.01); *B65H 2511/135* (2013.01); *B65H 2515/82* (2013.01); *B65H 2601/521* (2013.01); *B65H 2801/06* (2013.01)

(58) Field of Classification Search

CPC ..... B65H 3/0607; B65H 3/66; B65H 2404/5211; B65H 2404/522; B56H 2511/135

See application file for complete search history.

(56) References Cited

U.S. PATENT DOCUMENTS

| | | | | |
|---|---|---|---|---|
| 6,880,822 | B2 * | 4/2005 | Fukushima | B65H 1/022 271/157 |
| 9,073,714 | B2 * | 7/2015 | Kim | B65H 3/0607 |
| 9,352,918 | B2 * | 5/2016 | Aoki | B65H 1/02 |
| 9,382,088 | B2 * | 7/2016 | Miura | B65H 1/04 |

(Continued)

FOREIGN PATENT DOCUMENTS

| | | |
|---|---|---|
| JP | 7-295405 | 11/1995 |
| JP | 2004-149622 | 5/2004 |
| JP | 2008-247495 | 10/2008 |

(Continued)

*Primary Examiner* — Patrick Cicchino

(74) *Attorney, Agent, or Firm* — Harness, Dickey & Pierce P.L.C.

(57) ABSTRACT

A sheet transfer guide, which is disposed along a sheet conveyance passage through which a sheet passes, provided to guide the sheet, and is included in an image forming apparatus and an image reading device, includes a base material, a coat layer formed on the base material and having a surface roughness smaller than a surface roughness of the base material, and a guide face to which the sheet contacts. The coat layer is formed on the guide face.

14 Claims, 9 Drawing Sheets

(56) References Cited

U.S. PATENT DOCUMENTS

| | | | | |
|---|---|---|---|---|
| 9,561,923 | B2 * | 2/2017 | Tatsumi | B65H 3/66 |
| 9,731,925 | B2 * | 8/2017 | Miura | B65H 29/22 |

FOREIGN PATENT DOCUMENTS

| | | |
|---|---|---|
| JP | 2009-109739 | 5/2009 |
| JP | 2011-168670 | 9/2011 |
| JP | 2015-055709 | 3/2015 |
| JP | 2016-006492 | 1/2016 |

* cited by examiner

SHEET TRANSFER GUIDE, IMAGE FORMING APPARATUS INCORPORATING THE SHEET TRANSFER GUIDE, AND IMAGE READING DEVICE INCORPORATING THE SHEET TRANSFER GUIDE

CROSS-REFERENCE TO RELATED APPLICATION

This patent application is based on and claims priority pursuant to 35 U.S.C. § 119(a) to Japanese Patent Application No. 2016-115298, filed on Jun. 9, 2016, in the Japan Patent Office, the entire disclosure of which is hereby incorporated by reference herein.

BACKGROUND

Technical Field

This disclosure relates to a sheet transfer guide, an image forming apparatus incorporating the sheet transfer guide, and an image reading device incorporating the sheet transfer guide.

Related Art

Various types of image forming apparatuses and image reading devices include a sheet transfer guide that is made of resin or metal and is disposed in a sheet conveyance passage of a sheet such as a recording medium and an original document, so as to guide the sheet conveyed along the sheet conveyance passage.

A known sheet transfer guide is a member to guide a sheet conveyed to a transfer section of an electrophotographic image forming apparatus. By forming the sheet transfer guide by a glass fiber reinforced acrylonitrile-butadiene-styrene resin, the sheet transfer guide can be enhanced in not only the rigidity and heat resistance of the sheet transfer guide but also the wear resistance when the sheet transfer guide is used for a long period of time. By contrast, a sheet transfer guide made of such a resin is not sufficient for reducing sound of sheet conveyance occurred while guiding the sheet.

SUMMARY

At least one aspect of this disclosure provides a sheet transfer guide disposed along a sheet conveyance passage through which a sheet passes and provided to guide the sheet. The sheet transfer guide includes a base material, a coat layer formed on the base material and having a surface roughness smaller than a surface roughness of the base material, and a guide face to which the sheet contacts. The coat layer is formed on the guide face.

Further, at least one aspect of this disclosure provides an image forming apparatus including the above-described sheet transfer guide and an image forming device. The sheet transfer guide is disposed along a sheet conveyance passage through which a sheet passes. The sheet transfer guide is configured to guide the sheet. The image forming device is configured to form an image on a surface of the sheet.

Further, at least one aspect of this disclosure provides an image reading device including the above-described sheet transfer guide and an image reader. The sheet transfer guide is disposed along the sheet conveyance passage through which the sheet passes. The sheet transfer guide is conveyed to guide the sheet having an image. The image reader is configured to read the image formed on the sheet conveyed by the sheet transfer guide.

DETAILED DESCRIPTION

Figure 1:
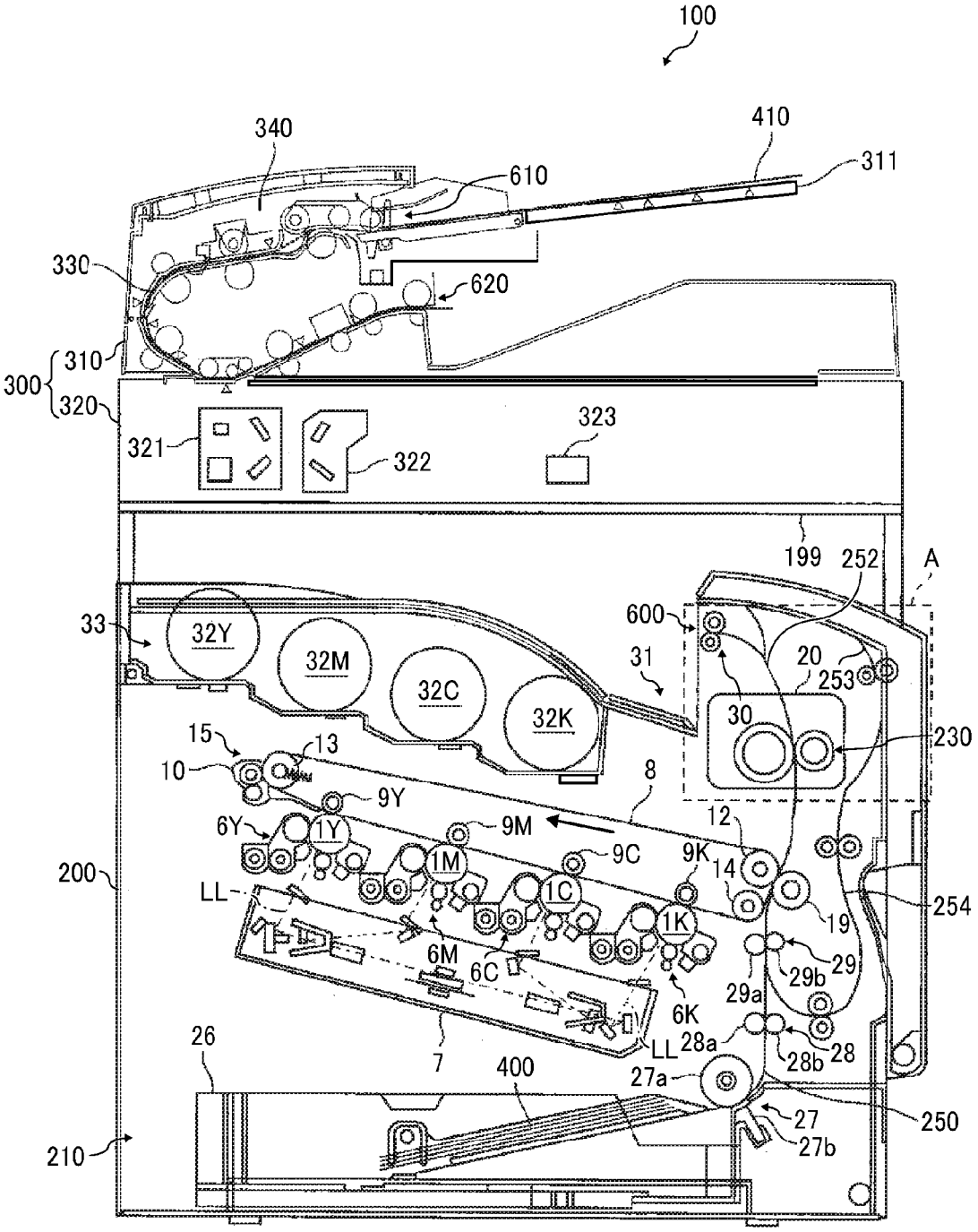
FIG. 1 is a diagram illustrating a schematic configuration of an image forming apparatus including a sheet transfer guide according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout.

As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus according to an embodiment of this disclosure, with reference to drawings.

It is to be noted that identical parts are given identical reference numerals and redundant descriptions are summarized or omitted accordingly.

Now, descriptions are given of an image forming apparatus 100 according to an embodiment of this disclosure, with reference to the following figures.

Figure 2:
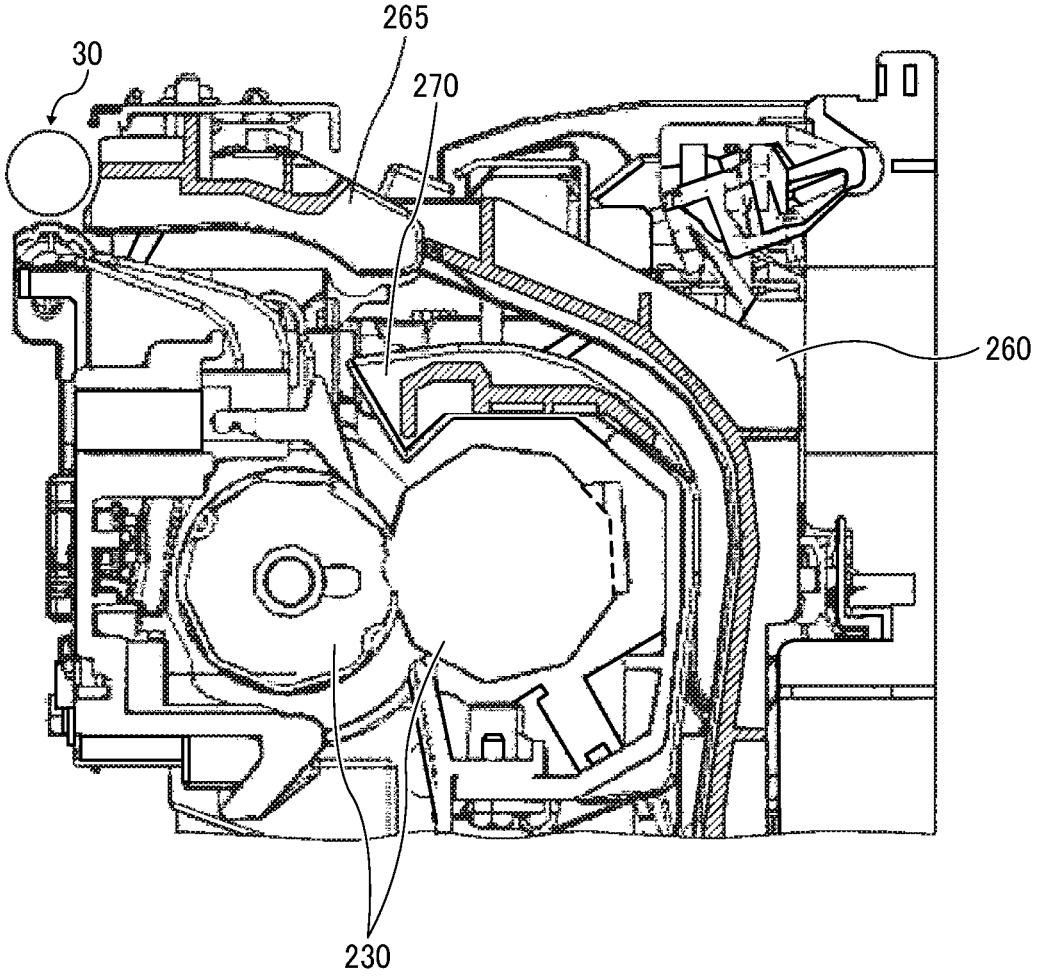
FIG. 2 is an enlarged view illustrating a fixing section in the image forming apparatus according to an embodiment of this disclosure.

FIG. 1 is a schematic diagram illustrating a configuration of the image forming apparatus 100 including a sheet transfer guide according to an embodiment of this disclosure. FIG. 2 is an enlarged view illustrating a fixing section A near a fixing device 20 of the image forming apparatus 100.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

As illustrated in FIG. 1, the image forming apparatus 100 is an electrophotographic image forming apparatus and includes an apparatus body 200 that is a printer engine and an image reading device 300.

It is to be noted that the present embodiment describes an electrophotographic image forming apparatus. However, the image forming method of the image forming apparatus 100 may be other types such as an inkjet method.

The apparatus body 200 of the image forming apparatus 100 is a section in which a toner image is formed on a sheet 4 (such as a recording sheet) that functions as a recording medium that is fed and supplied from a sheet feeding device 210 that functions as a sheet supplying portion, based on image data of an image read by the image reading device 300 or image data that is sent by an external device.

The image reading device 300 includes an automatic document feeder 310 and a scanner 320. The automatic document feeder 310 is hereinafter referred to as the ADF 310. The ADF 310 functions as a sheet conveying device. The ADF 310 feeds an original document 410 that is an image reading target sheet set by an operator, and the scanner 320 reads an image on the original document 410 fed by the ADF 310.

A sheet 400 and the original document 410 are target sheets to be transferred. The thickness of the target sheet such as the sheet 400 and the original document 410 is in a range, for example, from 50 μm to 500 μm. The sheet 400 and the original document 410 that include a high quality paper having the thickness of approximately 100 μm (for example, the thickness of 100 μm±10 μm are also target sheets to be transferred.

The apparatus body 200 (that is a printer engine) includes four image forming units 6Y, 6M, 6C, and 6K to form yellow (Y), magenta (M), cyan (C), and black (K) toner images, respectively. The configurations of the image forming units 6Y, 6M, 6C, and 6K are basically identical to each other, except that the image forming units 6Y, 6M, 6C, and 6K include toners of different colors as image forming substances. Each of the image forming units 6Y, 6M, 6C, and 6K is replaced at the end of the service life. As illustrated in FIG. 1, the image forming units 6Y, 6M, 6C, and 6K includes drum-shaped photoconductors 1Y, 1M, 1C, and 1K, each of which functions as an image bearer, drum cleaning devices that function as a photoconductor cleaner, static eliminating devices, charging devices, and developing devices. Each of the image forming units 6Y, 6M, 6C, and 6K is detachably attachable to the apparatus body 200 of the image forming apparatus 100 and consumable parts provided in each of the image forming units 6Y, 6M, 6C, and 6K can be replaced at one time.

As illustrated in FIG. 1, an optical writing unit 7 is disposed vertically below the image forming units 6Y, 6M, 6C, and 6K.

The optical writing unit 7 functions as a latent image forming device. The optical writing unit 7 emits a laser light LL based on image data to optically expose to the respective photoconductors 1Y, 1M, 1C, and 1K in the image forming units 6Y, 6M, 6C, and 6K. Due to this optical exposure, an electrostatic latent image is formed on the surface of each of the photoconductors 1Y, 1M, 1C, and 1K.

It is to be noted that, while causing a polygon motor to rotate a polygon mirror so as to deflect the laser light L emitted by a light source in a main scanning direction (an axial direction of each of the photoconductors 1Y, 1M, 1C, and 1K), the optical writing unit 7 irradiates the deflected laser light LL to each of the photoconductors 1Y, 1M, 1C, and 1K via multiple optical lenses and mirrors.

The image forming apparatus 100 further includes a sheet feeding device 210 below the optical writing unit 7. The sheet feeding device 210 includes a sheet container 26 and a separation device 27 that is incorporated in the sheet container 26. The sheet container 26 accommodates multiple sheets 400 as a bundle of sheets. The separation device 27 includes a rotatable feed roller 27*a* and a separation pad 27*b* that contacts the feed roller 27*a*. A sheet separation nip region is formed between the feed roller 27*a* and the separation pad 27*b*.

The feed roller 27*a* of the separation device 27 contacts an uppermost sheet 400 placed on the bundle of sheets 400 accommodated in the sheet container 26. The feed roller 27*a* rotates to feed the sheet 400 to the sheet separation nip region. In a case in which multiple sheets 400 are conveyed to the sheet separation nip region in layer, the uppermost sheet 400 of the multiple sheets 400 contacts the feed roller 27*a*. The uppermost sheet 400 follows movement of the surface of the feed roller 27*a*, and moves in a sheet conveying direction in the sheet separation nip region. By contrast, the separation pad 27*b* that does not follow the movement of the surface of the feed roller 27*a* applies load resistance to the multiple sheets 400 other than the uppermost sheet 400. Due to the load resistance applied by the separation pad 27*b*, these multiple sheets 400 cannot follow the uppermost sheet 400 that continuously moves in the sheet conveying direction, and therefore remain in the sheet separation nip region. Accordingly, the separation device 27 separates the uppermost sheet 400 alone from the multiple sheets 400 fed from the sheet container 26 and conveys the uppermost sheet 400 from the sheet separation nip region toward a first sheet conveyance passage 250.

A pair of sheet conveying rollers 28 that functions as a contact conveyance body is disposed in a middle point in a longitudinal direction of the first sheet conveyance passage 250. The pair of sheet conveying rollers 28 includes a first sheet conveying roller 28*a* and a second sheet conveying roller 28*b*, both of which function as conveyance bodies. The first sheet conveying roller 28*a* and the second sheet conveying roller 28*b* form a sheet conveyance nip region therebetween. Of the two conveying rollers, at least the first sheet conveying roller 28*a* is driven to rotate by a drive device.

A pair of registration rollers 29 that functions as a contact conveyance body is disposed in a vicinity of a terminal end in the longitudinal direction of the first sheet conveyance passage 250. The pair of registration rollers 29 includes a first registration roller 29*a* and a second registration roller 29*b*, both of which function as contact conveyance bodies. The first registration roller 29*a* and the second registration roller 29*b* form a registration nip region that functions as a contact conveyance nip region therebetween. Of the two registration rollers, at least the first registration roller 29*a* is driven to rotate by a drive device.

The first sheet conveying roller 28*a* of the pair of sheet conveying rollers 28 starts rotating at a substantially same time or with a relatively short time lag as a timing when the feed roller 27*a* of the separation device 27 starts rotating. The leading end of the sheet 400 that is conveyed to the sheet conveyance passage from the sheet separation nip region of the separation device 27 is eventually held by the sheet conveyance nip region of the pair of sheet conveying rollers 28. The first sheet conveying roller 28*a* is rotated at a linear velocity faster than the feed roller 27*a*. At this time, the sheet 400 is pulled significantly taut between the sheet separation nip region and the sheet conveyance nip region. A large torque is applied to the feed roller 27*a*, and therefore a torque limiter operates so that the feed roller 27*a* is rotated with movement of the sheet 400. At this time the torque limiter operates irregularly, and therefore a back tension is applied to the sheet 400 irregularly. Further, the sheet 400 slips on the first sheet conveying roller 28*a*, which promotes wear of the first sheet conveying roller 28*a*.

After the sheet 400 is fed from the sheet conveyance nip region by rotation of the first sheet conveying roller 28*a* toward the pair of registration rollers 29, the leading end of the sheet 400 contacts the registration nip region. At this time, the rotation of the pair of registration rollers 29 is stopped, and therefore the sheet 400 cannot enter the registration nip region but gradually starts warping. According to this warping of the sheet 400, skew of the sheet 400 is corrected.

After the sheet 400 starts to be fed from the sheet conveyance nip region of the pair of sheet conveying rollers 28, upon a predetermined timing, rotation of the feed roller 27*a* of the separation device 27 and rotation of the pair of sheet conveying rollers 28 are caused to stop. Accordingly the conveyance of the sheet 400 is temporarily stopped while the leading end of the sheet 400 is being warped.

An intermediate transfer unit 15 is disposed above the image forming units 6Y, 6M, 6C, and 6K in FIG. 1. The intermediate transfer unit 15 includes an intermediate transfer belt 8 that functions as an intermediate transfer body. The intermediate transfer belt 8 rotates endlessly with being stretched. The intermediate transfer unit 15 includes the intermediate transfer belt 8, four primary transfer bias rollers 9Y, 9M, 9C, and 9K, a belt cleaning device 10, a secondary transfer backup roller 12, a cleaning backup roller 13, and a tension roller 14.

The intermediate transfer belt 8 includes three rollers disposed inside a loop. While being stretched by the three rollers, the intermediate transfer belt 8 is driven by at least one of the three rollers and is rotated endlessly in a counterclockwise direction in FIG. 1. The primary transfer bias rollers 9Y, 9M, 9C, and 9K contact the photoconductors 1Y, 1M, 1C, and 1K with the intermediate transfer belt 8 interposed therebetween and form respective primary transfer nip regions with the photoconductors 1Y, 1M, 1C, and 1K, respectively.

In this configuration of the present embodiment, each of the primary transfer bias rollers 9Y, 9M, 9C, and 9K applies a transfer bias having a polarity opposite the toner (for example, a positive polarity) to the back face of the intermediate transfer belt 8 (i.e., an inner circumferential surface of the loop of the intermediate transfer belt 8). The rollers in the configuration except the primary transfer bias rollers 9Y, 9M, 9C, and 9K are electrically grounded. In the course in which a yellow toner image formed on the photoconductor 1Y, a magenta toner image formed on the photoconductor 1M, a cyan toner image formed on the photoconductor 1C, and a black toner image formed on the photoconductor 1K pass the primary transfer nip regions along with endless movement of the intermediate transfer belt 8, the yellow, magenta, cyan, and black toner images are sequentially transferred onto a surface of the intermediate transfer belt 8 as primary transfer. Accordingly, a four color superimposed toner image (hereinafter, referred to as a "four color toner image") is formed on the surface of the intermediate transfer belt 8.

The secondary transfer backup roller 12 that is disposed inside the loop of the intermediate transfer belt 8 contacts the secondary transfer roller 19 that is disposed outside the loop of the intermediate transfer belt 8, with the intermediate transfer belt 8 interposed therebetween and forms a secondary transfer nip region with the secondary transfer roller 19. The four color toner image formed on the surface of the intermediate transfer belt 8 is transferred onto the sheet 400 in the secondary transfer nip region as secondary transfer.

After passing through the secondary transfer nip region, transfer residual toner that has not been transferred onto the sheet 400 remains on the intermediate transfer belt 8. The transfer residual toner remaining on the surface of the intermediate transfer belt 8 is removed by the belt cleaning device 10.

After the temporary stop of the rotation of the feed roller 27*a* and the rotation of the pair of sheet conveying rollers 28, at a timing in synchronization of arrival of the four-color toner image formed on the intermediate transfer belt 8 in the secondary transfer nip region, the rotation of the feed roller 27*a* and the rotation of the pair of sheet conveying rollers 28 resume. In addition, the pair of registration rollers 29 starts rotating. According to these operations, the sheet 400 is fed in the registration nip region, and then is conveyed from the registration nip region toward the secondary transfer nip region. Then, in the secondary transfer nip region, the four color toner image formed on the surface of the intermediate transfer belt 8 is transferred onto the sheet 400.

After being conveyed from the secondary transfer nip region, the sheet 400 having the four color toner image thereon is conveyed to a fixing device 20 including a pair of fixing rollers 230. When passing the pair of fixing rollers 230, the four color toner image transferred onto the sheet 400 is fixed to the sheet 400 by application of heat and pressure. Thereafter, the sheet 400 passes between rollers of a pair of sheet output rollers 30, and is discharged outside the apparatus body 200 of the image forming apparatus 100. After having been ejected by the pair of sheet output rollers 30 to the outside of the apparatus body 200 of the image forming apparatus 100, the sheet 400 is sequentially stacked on a sheet stacking portion 31 formed on an upper face of the apparatus body 200.

A bottle container 33 is disposed between the intermediate transfer unit 15 and the sheet stacking portion 31 disposed above the intermediate transfer unit 15. The bottle container 33 includes toner bottles 32Y, 32M, 32C, and 32K, each of which functions as a supplying toner container, to store the yellow, magenta, cyan, and black toners therein. Each of the toner bottles 32Y, 32M, 32C, and 32K is set to place on the bottle container 33 from above. The yellow, magenta, cyan, and black toners stored in the toner bottles 32Y, 32M, 32C, and 32K are supplied appropriately to the developing devices of the image forming units 6Y, 6M, 6C, and 6K by respective toner supplying devices, each of which functions as a toner conveyance body. The toner bottles 32Y, 32M, 32C, and 32K are detachably attached to the apparatus body 200 and separately disposed from the image forming units 6Y, 6M, 6C, and 6K.

A switchback device is disposed in the vicinity of the fixing device 20. In a duplex printing mode by which images are formed on both sides of the sheet 400, after the sheet 400 having an image on the first (front) side alone has passed through the fixing device 20, the switchback device causes the sheet 400 to reverse upside down. The vertically reversed sheet 400 passes through a sheet reverse passage 254 and toward the registration nip region of the pair of registration rollers 29. After the sheet 400 is conveyed from the registration nip region to the secondary transfer nip region and the toner image is formed on the second (back) side of the sheet 400, the fixing device 20 fixes the toner image formed on the second side to the sheet 400. Then, the sheet 400 having images on both sides is conveyed to the pair of sheet output rollers 30 and is stacked on the sheet stacking portion 31.

The image reading device 300 is disposed above the apparatus body 200 (the printer engine) of the image forming apparatus 100. The image reading device 300 includes the ADF 310 and the scanner 320. The image reading device 300 is fixed on a rack 199 having two legs and fixed to the back face of the apparatus body 200. There is a relatively large space between the sheet stacking portion 31 of the apparatus body 200 and the rack 199. The sheet 400 is stacked in the space on the sheet stacking portion 31.

The scanner 320 of the image reading device 300 includes a fixed reading unit 321 and a movable reading unit 322.

The movable reading unit 322 is disposed immediately below a second exposure glass. The movable reading unit 322 can move optical components such as a light source and multiple reflection mirrors in left and right directions (in a horizontal direction) in FIG. 1. The second exposure glass is fixedly mounted on an upper wall of a casing of the scanner 320 so as to contact the original document 410. In the course of moving the optical components from left to right in FIG. 1, the light source emits the light. After a surface of the original document 410 placed on the second exposure glass reflects the laser light LL, the reflected light is further reflected on multiple reflection mirrors until an image reading sensor 323 that is secured to the scanner 320 receives the reflected light.

By contrast, the first fixed reading unit 321 includes a light source, multiple reflection mirrors, and multiple image reading sensors such as charge coupled device (CCD) sensors. The first fixed reading unit 321 is disposed immediately below a first exposure glass that is fixedly mounted on the upper wall of the casing of the scanner 320 so as to contact the original document 410. When the original document 410 that is conveyed by the ADF 310 passes over the first exposure glass, the light source emits light. After a first face (a lower face) of the original document 410 sequentially reflects the light, the reflected light is further reflected on multiple reflection mirrors until the image reading sensor 323 receives the reflected light. With the above-described operations, the first face of the original document 410 is scanned without moving the optical components such as the light source and the multiple reflection mirrors.

It is to be noted that the ADF 310 includes a second face reading sensor that optically scans a second face of the original document 410.

In a case in which a bundle of original documents formed by multiple original documents 410 accumulated in layers is set on the ADF 310, the original documents 410 can be conveyed one by one automatically. Consequently, the image formed on the original document 410 that is automatically conveyed to the image reading device 300 can be read by the fixed reading unit 321 in the scanner 320 and a second fixed reading unit in the ADF 310. In this case, a copy start button is pressed after the bundle of original documents is set on a original document loading table 311 of the ADF 310. Then, the ADF 310 starts conveyance of the original documents 410 to convey each original document 410 sequentially from top of the bundle of original documents loaded on the original document loading table 311. In the course of conveying the original documents 410, immediately after the original document 410 is reversed, the original document 410 is caused to pass right above the fixed reading unit 321 of the scanner 320. At this time, the image on the first face of the original document 410 is read by the fixed reading unit 321 of the scanner 320.

In the image forming apparatus 100 having the above-described configuration, the apparatus body 200 includes the first sheet conveyance passage 250, a second sheet conveyance passage 252, and a third sheet conveyance passage 253. Each of the first sheet conveyance passage 250, the second sheet conveyance passage 252, and the third sheet conveyance passage 253 functions as a sheet conveyance passage through which the sheet 400 is conveyed.

In the first sheet conveyance passage 250, the sheet 400 fed by the feed roller 27*a* from the sheet feeding device 210 is conveyed to a secondary transfer position where the secondary transfer backup roller 12 and the secondary transfer roller 19 are disposed facing each other via the pair of sheet conveying rollers 28 and the pair of registration rollers 29. At the secondary transfer position, the toner image formed on the intermediate transfer belt 8 is transferred onto the sheet 400.

In the second sheet conveyance passage 252, the sheet 400 onto which the toner image is formed at an image forming position passes through a fixing nip region of the pair of fixing rollers 230 where the toner image is fixed to the sheet 400. The sheet 400 is then conveyed to be output onto the sheet stacking portion 31 via the pair of sheet output rollers 30.

In the third sheet conveyance passage 253, the sheet 400 that has passed through the fixing nip region of the pair of fixing rollers 230 is conveyed to the sheet reverse passage 254 so as to form the toner images on both sides by duplex printing.

The image reading device 300 includes an original document conveyance passage 330 that functions as a sheet conveyance passage to pass the original document 410 therethrough. In the original document conveyance passage 330, the original document 410 that has been fed from the ADF 310 is conveyed to a document image reading position in the scanner 320.

Figure 3A:
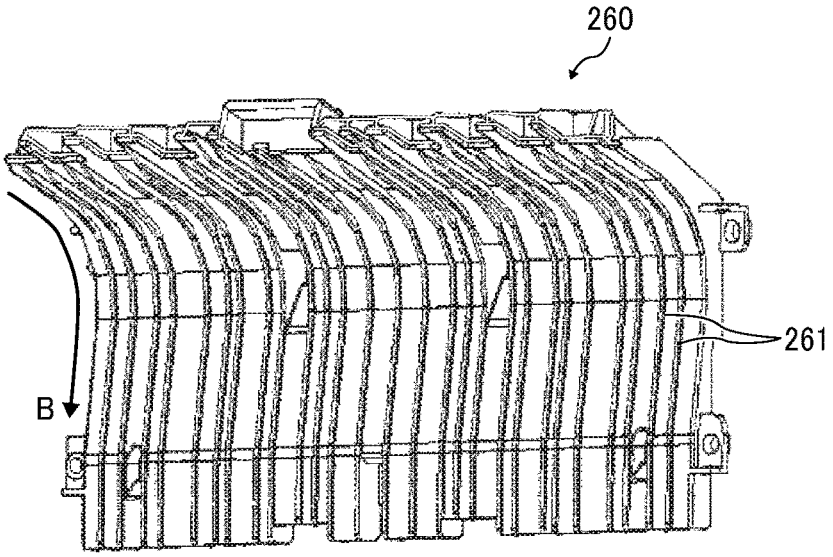
FIG. 3A is a perspective view illustrating a sheet transfer guide having a third sheet conveyance passage in an apparatus body of the image forming apparatus according to an embodiment of this disclosure.
Figure 3B:
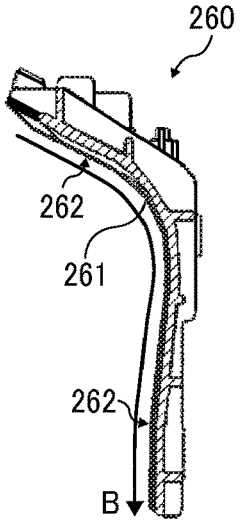
FIG. 3B is a cross sectional view illustrating the sheet transfer guide of FIG. 3A.
Figure 3C:
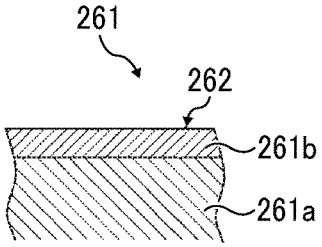
FIG. 3C is a cross sectional view illustrating a rib portion of the sheet transfer guide of FIG. 3A.

FIG. 3A is a perspective view illustrating a sheet transfer guide 260 that has the third sheet conveyance passage 253 provided to cause the sheet 400 to pass through after the fixing section, toward the sheet reverse passage 254. FIG. 3B is a cross sectional view illustrating the sheet transfer guide 260 of FIG. 3A. FIG. 3C is a cross sectional view illustrating a rib portion 261 of the sheet transfer guide 260.

The sheet transfer guide 260 includes the rib portion 261 and a guide face 262. The rib portion 261 includes multiple projections extending in a sheet conveying direction B. The multiple projections of the rib portion 261 are partially formed at predetermined intervals in a width direction of the sheet 400 perpendicular to the sheet conveying direction B. The guide face 262 is a top surface of the rib portion 261 that contacts the sheet 400. Further, the guide face 262 including the top surface of the rib portion 261 has a concave shape or a recess curved in the sheet conveying direction B. Further, the guide face 262 that contacts the sheet 400 has a coat layer 261*b* that has a surface roughness Ra smaller than a surface roughness Ra of a base material 261*a* of the sheet transfer guide 260.

Here, the surface roughness Ra represents an arithmetic average roughness defined in JIS B0601 2001.

Figure 4A:
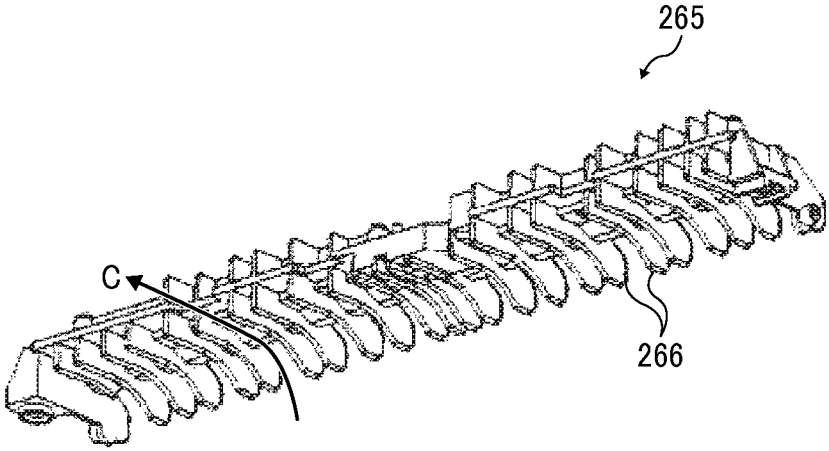
FIG. 4A is a perspective view illustrating a sheet transfer guide having a second sheet conveyance passage in the apparatus body of the image forming apparatus according to an embodiment of this disclosure.
Figure 4B:
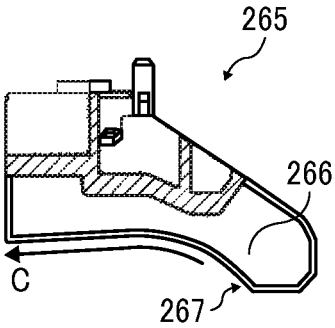
FIG. 4B is a cross sectional view illustrating the sheet transfer guide of FIG. 4A.
Figure 4C:
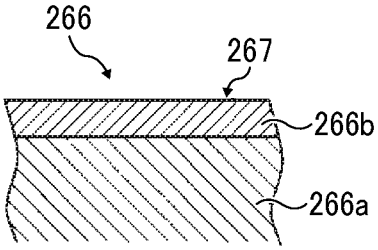
FIG. 4C is a cross sectional view illustrating a rib portion of the sheet transfer guide of FIG. 4A.

FIG. 4A is a perspective view illustrating a sheet transfer guide 265 that has the second sheet conveyance passage 252 provided to cause the sheet 400 to pass through after the fixing section, toward the pair of sheet output rollers 30. FIG. 4B is a cross sectional view illustrating the sheet transfer guide 265 of FIG. 4A. FIG. 4C is a cross sectional view illustrating a rib portion 266 of the sheet transfer guide 265.

The sheet transfer guide 265 includes the rib portion 266 and a guide face 267. The rib portion 266 includes multiple projections extending in a sheet conveying direction C. The multiple projections of the rib portion 261 are partially formed at predetermined intervals in the width direction of the sheet 400 perpendicular to the sheet conveying direction C. The guide face 267 is a top surface of the rib portion 266 that contacts the sheet 400. Further, the guide face 267 including the top surface of the rib portion 266 has a concave shape or a recess curved in the sheet conveying direction C. Further, the guide face 267 that contacts the sheet 400 has a coat layer 266*b* that has a surface roughness Ra smaller than a surface roughness Ra of a base material 266*a* of the sheet transfer guide 265.

Figure 5A:
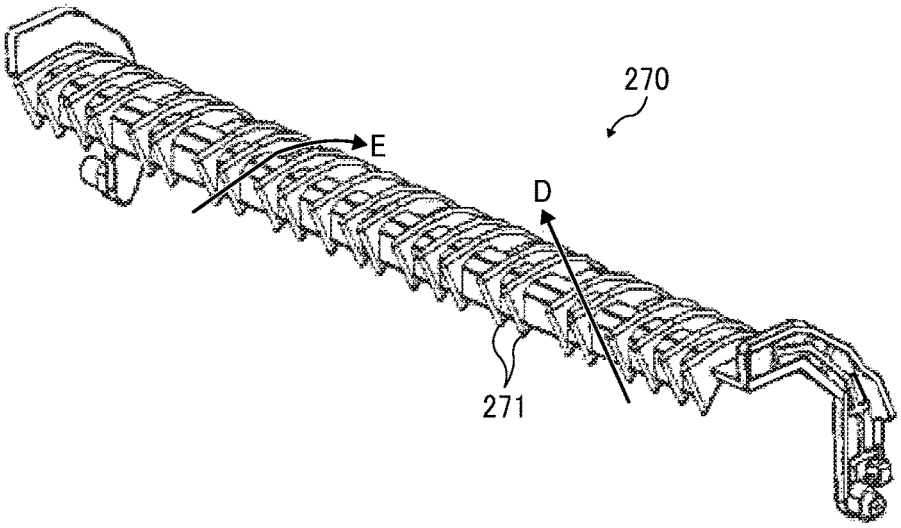
FIG. 5A is a perspective view illustrating a sheet transfer guide having the second and third sheet conveyance passages in the apparatus body of the image forming apparatus according to an embodiment of this disclosure.
Figure 5B:
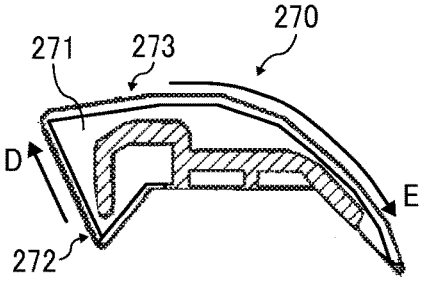
FIG. 5B is a cross sectional view illustrating the sheet transfer guide of FIG. 5A.
Figure 5C:
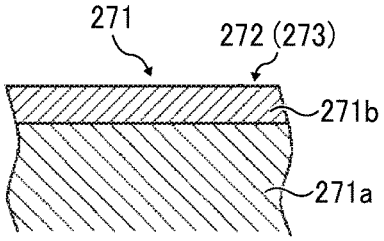
FIG. 5C is a cross sectional view illustrating a rib portion of the sheet transfer guide of FIG. 5A.

FIG. 5A is a perspective view illustrating a sheet transfer guide 270 that has the second sheet conveyance passage 252 and the third sheet conveyance passage 253. FIG. 5B is a cross sectional view illustrating the sheet transfer guide 270 of FIG. 5A. FIG. 5C is a cross sectional view illustrating a rib portion 271 of the sheet transfer guide 270

The sheet transfer guide 270 includes the rib portion 271 and guide faces 272 and 273. The rib portion 271 includes multiple projections extending in a sheet conveying direction D and a sheet conveying direction E. The multiple projections of the rib portion 271 are partially formed at predetermined intervals in the width direction of the sheet 400 perpendicular to the sheet conveying direction D and the sheet conveying direction E. The guide faces 272 and 273 are respective top surfaces of the rib portion 271 that contact the sheet 400. Out of the two guide faces 272 and 273 including the top surfaces of the rib portion 271, the guide face 272 including the top surface extending in the sheet conveying direction D forms the second sheet conveyance passage 252 through which the sheet 400 that has passed the fixing section is conveyed toward a nip region of the pair of sheet output rollers 30. Further, the guide face 272 has a flat shape in the sheet conveying direction D. The guide face 273 extending in the sheet conveying direction E forms the third sheet conveyance passage 253 through which the sheet 400 that has passed the fixing section is conveyed toward the sheet reverse passage 254. The guide face 273 is warped outwardly to form a projection to fit to the curved surface of the sheet transfer guide 260 in the sheet conveying direction E. Further, the two guide faces 272 and 273 that contact the sheet 400 have respective coat layers 271*b*, each of which has a surface roughness Ra smaller than a surface roughness Ra of a base material 271*a* of the sheet transfer guide 270.

Figure 6A:
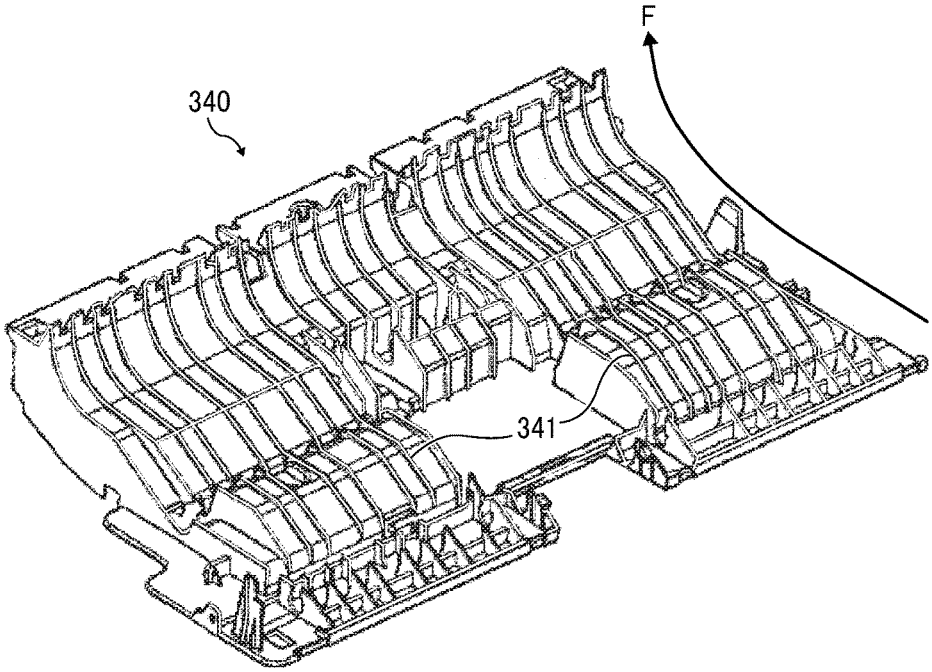
FIG. 6A is a perspective view illustrating a sheet transfer guide disposed in an image reading device provided to the image forming apparatus according to an embodiment of this disclosure.
Figure 6B:
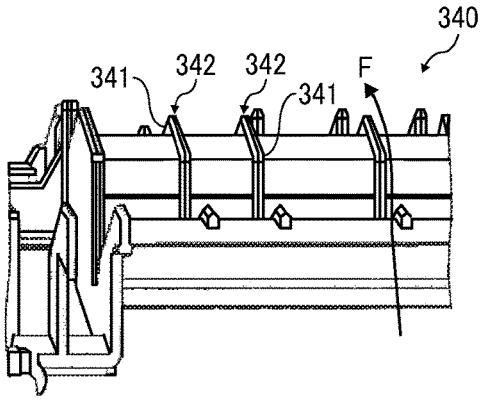
FIG. 6B is a cross sectional view illustrating the sheet transfer guide of FIG. 6A.
Figure 6C:
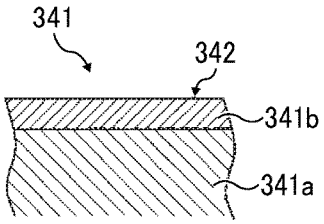
FIG. 6C is a cross sectional view illustrating a rib portion of the sheet transfer guide of FIG. 6A.

FIG. 6A is a perspective view illustrating a sheet transfer guide 340 that has the original document conveyance passage 330 provided to cause the original document 410 to pass through after having been fed from the ADF 310, toward the image reading position of the scanner 320. FIG. 6B is a cross sectional view illustrating the sheet transfer guide 340 of FIG. 6A. FIG. 6C is a cross sectional view illustrating a rib portion 341 of the sheet transfer guide 340.

The sheet transfer guide 340 includes the rib portion 341 and a guide face 342. The rib portion 341 includes multiple projections extending in a document conveying direction F. The multiple projections of the rib portion 341 are partially formed at predetermined intervals in the width direction of the original document 410 perpendicular to the document conveying direction F. The guide face 342 is a top surface of the rib portion 341 that contacts the original document 410. Further, the guide face 342 including the top surface of the rib portion 341 has a curved shape in the document conveying direction F. Further, the guide face 342 that contacts the original document 410 has a coat layer 341*b* that has a surface roughness Ra smaller than a surface roughness Ra of a base material 341*a* of the sheet transfer guide 340.

Table 1 presents examples of materials including resin material and filler, which can be used for the base materials 261*a*, 266*a*, 271*a*, and 341*a* of the sheet transfer guides 260, 265, 270, and 340 provided to the image forming apparatus 100 according to the present embodiment of this disclosure.

TABLE 1

| Resin Materials | Symbol |
|---|---|
| 1 | ABS-FR (17) |
| 2 | PET-GF |
| 3 | PBT + ABS |
| 4 | PC + ABS-(TD + MD)5FR(40) |

"ABS-FR(17)" indicated as Resin Material 1 in Table 1 represents a flame retardant acrylonitrile-butadiene-styrene (ABS) resin to which a flame retardance of combination of an aromatic bromine compound and an antimony compound is added. "PET-GF" indicated as Resin Material 2 in Table 1 represents a polyethylene terephthalate resin including glass fiber as a filler. "PBT + ABS" indicated as Resin Material 3 in Table 1 represents an alloy of polybutylene terephthalate and ABS resin. "PC + ABS-(TD + MD)5FR(40)" indicated as Resin Material 4 in Table 1 represents an alloy of polycarbonate and acrylonitrile-butadiene-styrene including Talcum powder (TD) and mineral powder (MD) as fillers. Resin Materials 1 through 4 may include carbon fiber as a filler. Resin Materials 1, 3, and 4 in Table 1 may include glass fiber as a filler.

Further, as described above, the guide face 262 of the sheet transfer guide 260 includes the coat layer 261*b*, the guide face 267 of the sheet transfer guide 265 includes the coat layer 266*b*, the guide faces 272 and 273 of the sheet transfer guide 270 include the coat layer 271*b*, and the guide face 342 of the sheet transfer guide 340 includes the coat layer 341*b*. These coat layers 261*b*, 266*b*, 271*b*, and 341*b* can be formed by applying liquid type coat layer material by any application methods described below, to the guide faces 262, 267, 272 and 273, and 342, respectively. Due to solidification of the coat layer materials applied onto the guide faces 262, 267, 272 and 273, and 342, the coat layers 261*b*, 266*b*, 271*b*, and 341*b* have the surface roughness Ra smaller than the surface roughness Ra of the base materials 261*a*, 266*a*, 271*a*, and 341*a*. With the coat layers 261*b*, 266*b*, 271*b*, and 341*b*, the surface roughness on the guide face of each sheet transfer guide to which the sheet contacts can be reduced, and therefore the sound of sheet conveyance occurred while guiding the sheet such as the sheet 400 and the original document 410 can be reduced.

In the image forming apparatus 100, the second sheet conveyance passage 252 includes an opening 600 at one end exposed to the outside of the apparatus body 200 of the image forming apparatus 100, and the original document conveyance passage 330 includes openings 610 and 620 at both ends exposed to the outside of the ADF 310 of the image forming apparatus 100.

It is to be noted that the above-described coat layer materials may be a material that can be applied to the guide faces 262, 267, 272 and 273, and 342 of the sheet transfer guides 260, 265, 270, and 340, respectively, and may have the above-described predetermined surface roughness when solidified after application.

Further, each of the coat layers 261*b*, 266*b*, 271*b*, and 341*b* may be a layer that does not move to the surface of the sheet even when the sheet such as the sheet 400 and the original document 410 contacts thereto. In this case, the functions of the coat layers 261*b*, 266*b*, 271*b*, and 341*b* can be maintained for a long period of time, and therefore the sound of sheet conveyance can also be reduced for a long period of time.

Further, each of the coat layers 261*b*, 266*b*, 271*b*, and 341*b* formed on the guide faces 262, 267, 272 and 273, and 342 of the sheet transfer guides 260, 265, 270, and 340 may have a film thickness equal to or smaller than 50 μm. Further, each of the coat layers 261*b*, 266*b*, 271*b*, and 341*b* may have a film thickness greater than 20 μm.

Further, the surface roughness Ra of each of the coat layers 261*b*, 266*b*, 271*b*, and 341*b* may be equal to or smaller than 0.2 μm. The surface roughness Ra of each of the base materials 261*a*, 266*a*, 271*a*, and 341*a* is equal to or greater than 0.2 μm and equal to or smaller than 3 μm.

Next, a description is given of a method of forming a coat layer having the surface roughness Ra smaller than the surface roughness Ra of the base material of the sheet transfer guide, to the guide face of each of the sheet transfer guides provided to the image forming apparatus 100.

Figure 7:
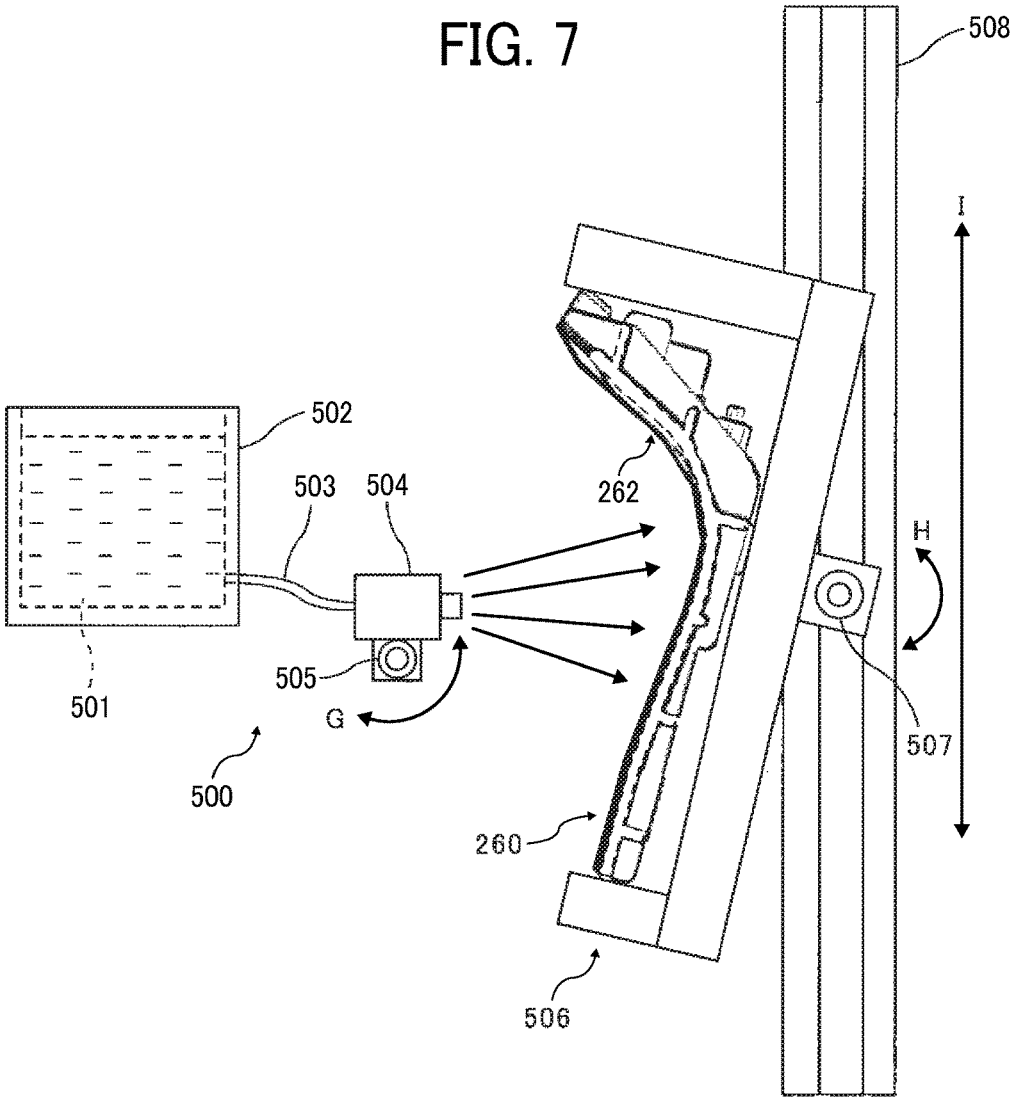
FIG. 7 is a diagram illustrating an application device used for manufacturing the sheet transfer guide according to an embodiment of this disclosure.

FIG. 7 is a diagram illustrating an application device 500 used for manufacturing the sheet transfer guide 260 according to an embodiment of this disclosure.

In FIG. 7, the application device 500 applies liquid type coat layer material to the guide face 262 of the sheet transfer guide 260 that defines the third sheet conveyance passage 253.

It is to be noted that a target of applying the coat layer material in application device 500 is not limited to the sheet transfer guide 260 but may be the sheet transfer guide 265, 270, or 340.

The application device 500 illustrated in FIG. 7 includes a liquid spray type application device.

The application device 500 includes a tank 502, a hose (or a pipe) 503, and a liquid spray portion 504. The tank 502 accommodates coating liquid 501 that is a liquid type coat layer material. The hose (pipe) 503 functions as a liquid supply passage forming body. The liquid spray portion 504 that is coupled with the tank 502 via the hose (pipe) 503.

Further, the application device 500 includes a holding mechanism that is movable by holding the sheet transfer guide 260. The sheet transfer guide 260 is held by the holding mechanism such that the guide face 262 of the sheet transfer guide 260 is disposed facing the liquid spray portion 504.

The liquid spray portion 504 includes a pump and a nozzle. The pump is a controllable pump that presses coating liquid supplied from the tank 502. The nozzle injects the pressed coating liquid radially. The liquid spray portion 504 is rotatable in a direction indicated by arrow G by a controllable rotary drive portion 505.

The holding mechanism includes a holding portion 506, a rotary drive portion 507, and a slide drive portion 508. The holding portion 506 holds the sheet transfer guide 260. The rotary drive portion 507 is controllable to slide the holding portion 506 while supporting and driving the holding portion 506. The rotary drive portion 507 can rotate in a direction indicated by arrow H while supporting the holding portion 506. The slide drive portion 508 can slide the rotary drive portion 507 while supporting the rotary drive portion 507. The rotation and sliding movement are controlled to cause an angle of injection direction of an injecting portion to the guide face 262 when a position of application on the guide face 262 is changed, for example.

The rotary drive portion 505 and the rotary drive portion 507 may include, for example, drive transmission components such as motors and gears, and drive shaft members. Further, the slide drive portion 508 may include, for example, a slide guide portion, a movable portion that is guided by the slide guide portion, and a slide drive unit that drives the movable portion. The slide drive unit may include, for example, a belt drive method, a rack and pinion method, and a linear motor method.

The pump of the liquid spray portion 504, the rotary drive portion 505, and the rotary drive portion 507 and the slide drive portion 508 of the holding mechanism are controlled by a controller that includes a central processing unit (CPU), based on a predetermined control program.

In the application device 500 having the above-described configuration, the sheet transfer guide 260 that is held by the holding mechanism can be slid while being rotated in a predetermined direction and the liquid spray portion 504 can inject coating liquid while being rotated. Accordingly, even when the guide face 262 of the sheet transfer guide 260 is warped as illustrated in FIG. 7, the coating liquid can be uniformly applied to the guide face 262 having the optional warped shape, so that the coat layer 261*b* having a uniform film thickness can be formed, as illustrated in FIG. 3C.

It is to be noted that the application device 500 illustrated in FIG. 7 causes the sheet transfer guide 260 to slide. However, the configuration of the application device 500 is not limited thereto. For example, the liquid spray portion 504 can be slid instead of the sheet transfer guide 260 or together with the sheet transfer guide 260.

Figure 8:
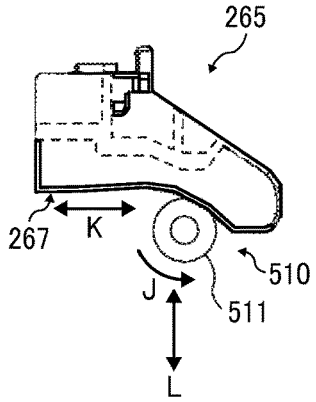
FIG. 8 is a diagram illustrating another application device used for manufacturing the sheet transfer guide according to an embodiment of this disclosure.

FIG. 8 is a diagram illustrating another application device used for manufacturing the sheet transfer guide according to an embodiment of this disclosure.

In FIG. 8, an application device 510 applies liquid type coat layer material to the guide face 267 of the sheet transfer guide 265 that defines the second sheet conveyance passage 252.

It is to be noted that a target of applying the coat layer material in the application device 510 is not limited to the sheet transfer guide 265 but may be the sheet transfer guide 260, 270, or 340.

The application device 510 illustrated in FIG. 8 includes an application roller type application device. The application device 510 includes an application roller 511 has a surface that is formed by material such as sponge, rubber, non-woven cloth, and felted fabric to which coating liquid that is liquid coat layer material is soaked. The application roller 511 rotates in a direction indicated by arrow J in FIG. 8 and slides in a direction indicated by arrow K and in a direction indicated by arrow L in FIG. 8. The direction K and the direction L are perpendicular to each other. A slide drive portion that causes the application roller 511 to slide is controlled by the controller that includes the CPU, based on a predetermined control program. It is to be noted that the application roller 511 may be rotated with movement of the guide face 267 of the sheet transfer guide 265 or may be rotated by a rotary drive portion.

The rotary drive portion may include, for example, drive transmission components such as motors and gears, and drive shaft members. Further, the slide drive portion may include, for example, a slide guide portion, a movable portion that is guided by the slide guide portion, and a slide drive unit that drives the movable portion. The slide drive unit may include, for example, a belt drive method, a rack and pinion method, and a linear motor method.

In the application device 510 having the above-described configuration, the application roller 511 slides in the direction K and the direction L so that the application roller 511 contacts the guide face 267 of the sheet transfer guide 265. Accordingly, even when the guide face 267 of the sheet transfer guide 265 is warped as illustrated in FIG. 8, the coating liquid can be uniformly applied to the guide face 267 having the optional warped shape, so that the coat layer 266*b* having a uniform film thickness can be formed, as illustrated in FIG. 4C.

It is to be noted that the application device 510 illustrated in FIG. 8 causes the application roller 511 to slide. However, the configuration of the application device 510 is not limited thereto. For example, the sheet transfer guide 265 can be slid instead of the application roller 511 or together with the application roller 511.

Figure 9:
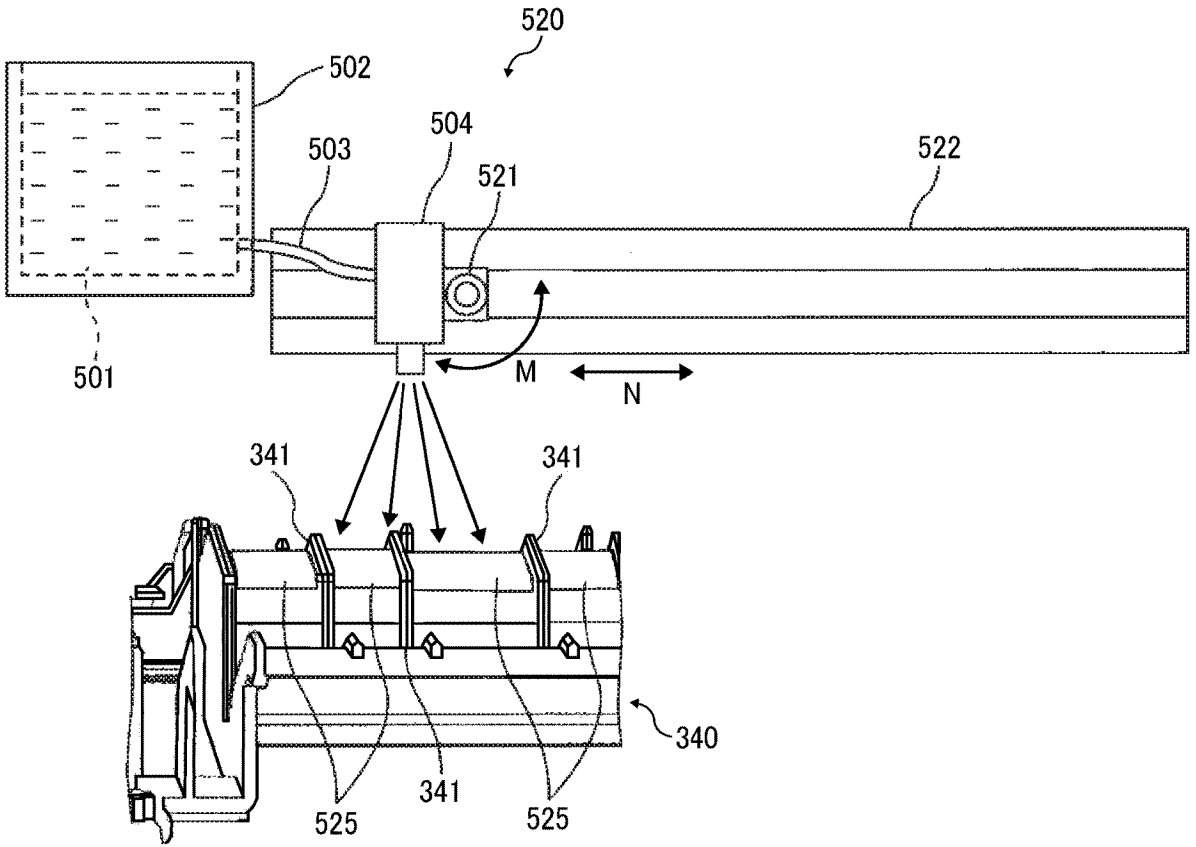
FIG. 9 is a diagram illustrating yet another application device used for manufacturing the sheet transfer guide according to an embodiment of this disclosure.

FIG. 9 is a diagram illustrating yet another application device used for manufacturing the sheet transfer guide according to an embodiment of this disclosure.

In FIG. 9, an application device 520 applies liquid type coat layer material to the guide face 342 of the sheet transfer guide 340 that defines the original document conveyance passage 330.

It is to be noted that a target of applying the coat layer material in the application device 520 is not limited to the sheet transfer guide 340 but may be the sheet transfer guide 260, 265, or 270.

The application device 520 illustrated in FIG. 9 includes a liquid spray type application device, which is the same configuration as the application device 500 illustrated in FIG. 7. It is to be noted that elements or components of the application device 520 may be denoted by the same reference numerals as those of the application device 500, and the descriptions thereof are omitted or summarized.

In FIG. 9, the application device 520 includes a holding mechanism that holds the sheet transfer guide 340 so that the guide faces 342 of the sheet transfer guide 340 are disposed facing the liquid spray portion 504. Further, except the guide faces 342, any possible areas to which coating liquid to be injected by the liquid spray portion 504 on the surface of the sheet transfer guide 340 are covered by covers 525. With the covers 525, the coating liquid is applied to the guide faces 342 alone, in other words, the coating liquid is not applied to the sheet transfer guide 340 on a surface to which the coating liquid is not supposed to be applied. Therefore, this configuration can prevent a failure such as dropping of coating liquid due to application of the coating liquid to the surface of the sheet transfer guide to which no application of the coating liquid is supposed.

The liquid spray portion 504 is rotatable in a direction in a direction indicated by arrow M by a rotary drive portion 521 that is controllable. The rotary drive portion 521 can slide in a direction indicated by N while being supported by a slide drive portion 522. The pump of the liquid spray portion 504, the rotary drive portion 521, and the slide drive portion 522 are controlled by the controller that includes the CPU, based on the predetermined control program.

The rotary drive portion 521 may include, for example, drive transmission components such as motors and gears, and drive shaft members. Further, the slide drive portion 522 may include, for example, a slide guide portion, a movable portion that is guided by the slide guide portion, and a slide drive unit that drives the movable portion. The slide drive unit may include, for example, a belt drive method, a rack and pinion method, and a linear motor method.

In the application device 520 having the above-described configuration, the liquid spray portion 504 can inject coating liquid while being slid and rotated. Accordingly, the coating liquid can be uniformly applied to the entire guide face 342 of the sheet transfer guide 340, so that the coat layer 341*b* having a uniform film thickness can be formed, as illustrated in FIG. 6C.

It is to be noted that the application device 520 illustrated in FIG. 9 causes the liquid spray portion 504 to slide. However, the configuration of the application device 520 is not limited thereto. For example, the sheet transfer guide 340 can be slid instead of the liquid spray portion 504 or together with the liquid spray portion 504.

Figure 10A:
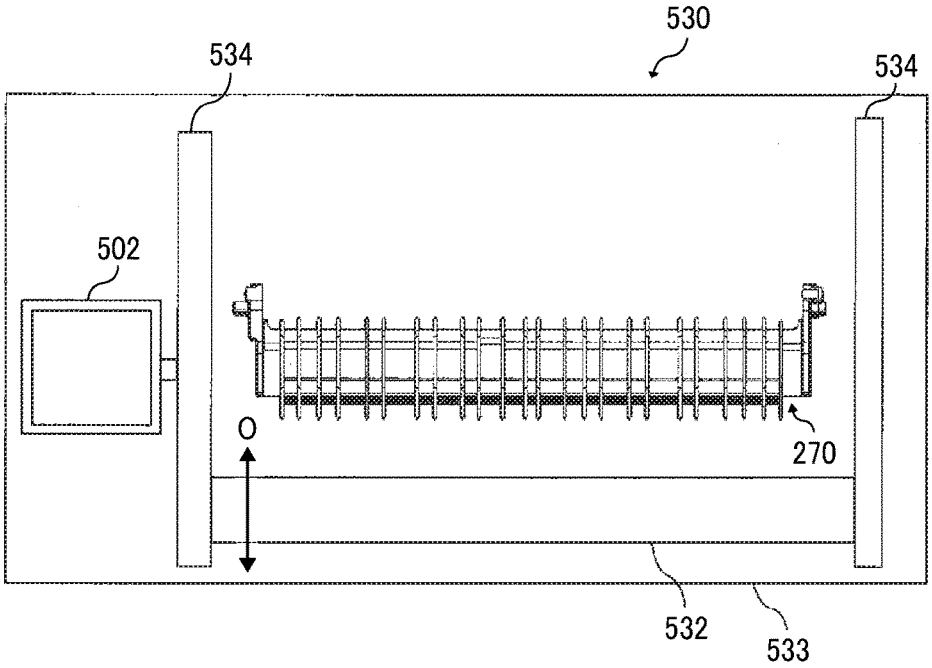
FIG. 10A is a plan view illustrating yet another application device used for manufacturing the sheet transfer guide according to an embodiment of this disclosure.
Figure 10B:
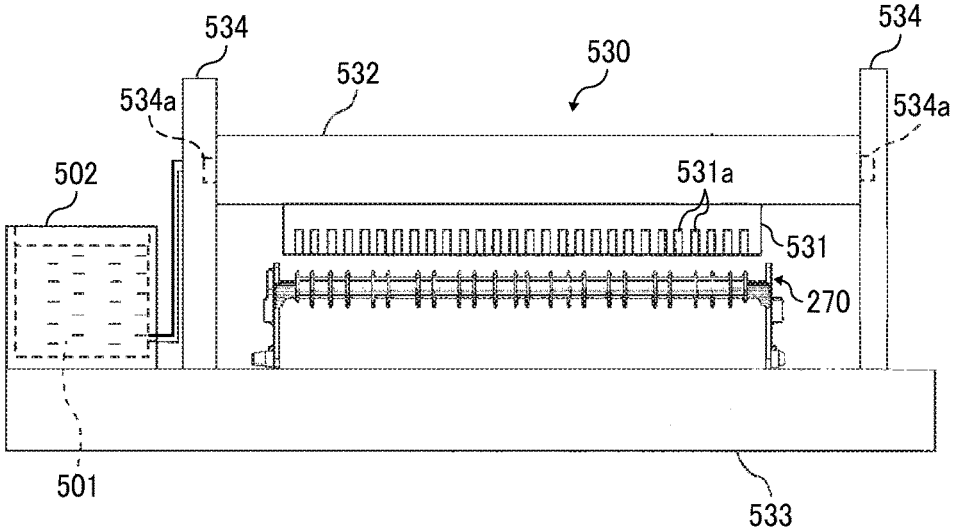
FIG. 10B is a front view illustrating the application device of FIG. 10A.

FIG. 10A is a plan view illustrating yet another application device used for manufacturing the sheet transfer guide according to an embodiment of this disclosure. FIG. 10B is a front view illustrating the application device of FIG. 10A.

It is to be noted that elements or components of an application device 530 may be denoted by the same reference numerals as those of the application device 500, and the descriptions thereof are omitted or summarized.

In FIG. 10, an application device 530 applies liquid type coat layer material to the guide faces 272 and 273 of the sheet transfer guide 270 that define the second sheet conveyance passage 252 and the third sheet conveyance passage 253. It is to be noted that a target of applying the coat layer material in the application device 530 is not limited to the sheet transfer guide 270 but may be the sheet transfer guides 260, 265, or 340.

The application device 530 illustrated in FIGS. 10A and 10B includes an inkjet type application device. The application device 530 includes a droplet discharging head 531 and a head moving device. The droplet discharging head 531 includes multiple nozzles 531*a* aligned in a row or in multiple rows. The head moving device moves the droplet discharging head 531. The droplet discharging head 531 is provided with liquid chambers. Each of the liquid chambers is provided to each of multiple nozzles 531*a* and is pressed by a piezoelectric element at an optional timing. Coating liquid is supplied from the tank 502 to each liquid chamber.

The sheet transfer guide 270 is set on a stage 533 such that the guide faces 272 and 273 are disposed facing the nozzles 531*a* of the droplet discharging head 531.

The head moving device includes a support arm 532 and a pair of slide drive units 534. The support arm 532 supports the droplet discharging head 531. The pair of slide drive units 534 includes rails 534*a* and slides to move the support arm 532 along the rails 534*a* while guiding the support arm 532 in a direction indicated by arrow O in FIG. 10A on the stage 533.

The discharge of droplets of coating liquid from each nozzle 531*a* of the droplet discharging head 531 and the pair of slide drive units 534 are controlled by the controller that includes the CPU, based on the predetermined control program.

Here, the discharge of droplets of coating liquid from each nozzle 531*a* of the droplet discharging head 531 may alternatively be controlled by the controller such that the coating liquid is applied to the guide face of the sheet transfer guide 270 alone.

The slide drive unit that drives the support arm 532 by the pair of slide drive units 534 may include, for example, a belt drive method, a rack and pinion method, and a linear motor method.

In the application device 530 having the above-described configuration, the droplet discharging head 531 discharges droplets of the coating liquid from the droplet discharging head 531 while the droplet discharging head 531 that is supported by the support arm 532 is moving in the direction θ in FIG. 10A. Accordingly, the coating liquid can be uniformly applied to the guide faces 272 and 273 having the optional shapes of the sheet transfer guide 270, so that the coat layer 271*b* having a uniform film thickness can be formed, as illustrated in FIG. 5C.

It is to be noted that the application device 530 illustrated in FIGS. 10A and 10B causes the droplet discharging head 531 to slide. However, the configuration of the application device 530 is not limited thereto. For example, the sheet transfer guide 270 can be slid instead of the droplet discharging head 531 or together with the droplet discharging head 531.

It is to be noted that the configurations of the above-described embodiments employ resin material as a base material of each of the sheet transfer guides. However, the material used for the sheet transfer guide is not limited thereto. For example, the base material of the sheet transfer guides may be metal.

The configurations according to the above-descried embodiments are not limited thereto. This disclosure can achieve the following aspects effectively.

Aspect A

A sheet transfer guide of Aspect A is disposed along a sheet conveyance passage through which a sheet passes and is provided to guide the sheet. The sheet transfer guide includes a guide face to which the sheet contacts, a base material, a coat layer, and a guide face. The coat layer is formed on the base material and has a surface roughness smaller than a surface roughness of the base material. The sheet contacts the guide face. The coat layer is formed on the guide face.

According to this configuration, as described in the above-described embodiments, the surface roughness can be reduced due to the coat layer formed on the guide face to which the sheet contacts with the sheet transfer guide.

Accordingly, by guiding the sheet on the guide face with the reduced surface roughness, when compared with a configuration in which a sheet is conveyed by the guide face of a comparative sheet transfer guide with the base material exposed, the sound of sheet conveyance can be reduced while the sheet is being guided.

Aspect B

In Aspect A, the coat layer does not transfer to a sheet side due to contact with the sheet.

According to this configuration, as described in the above-described embodiments, the functions of the coat layer can be maintained for a long period of time, and therefore the sound of sheet conveyance can be reduced for a long period of time.

Aspect C

In Aspect A or Aspect B, the coat layer has a film thickness equal to or less than 50 μM.

According to this configuration, as described in the above-described embodiments, even when the coat layer having the film thickness of 50 μm or smaller is provided to the sheet transfer guide, a good performance of sheet conveyance can be maintained without changing the dimensions of the base material of the sheet transfer guide and the position of the guide face.

Specifically, in a case in which the thickness of a target sheet to be conveyed is approximately 100 μm (for example, 100 μm±10 μm or greater, the film thickness of the coat layer is equal to or less than a half of the thickness of the sheet.

Therefore, according to this configuration, the good performance of sheet conveyance can be maintained reliably without changing the dimensions of the base material of the sheet transfer guide and the position of the guide face.

Aspect D

In any one of Aspect A through Aspect C, the coat layer has a thickness greater than 20 μm.

According to this configuration, as described in the above-described embodiments, the function of the coat layer that reduces the surface roughness can be performed reliably.

Aspect E

In any one of Aspect A through Aspect D, the coat layer has a surface roughness equal to or smaller than 0.2 μm and the base material has a surface roughness equal to or greater than 0.2 μm and equal to or less than 3 μm.

According to this configuration, as described in the above-described embodiments, the sound of sheet conveyance can be reduced more reliably for a long period of time and, at the same time, the base material can be manufactured easily, and therefore the manufacturing cost of the base material can be reduced.

Aspect F

In any one of Aspect A through Aspect E, the base material is formed by resin material.

According to this configuration, as described in the above-described embodiments, the base material of the sheet transfer guide can be molded easily, and therefore a high degree of freedom can be achieved in selection of materials of the coat layer.

Aspect G

In Aspect F, the base material includes at least a resin material and a filler.

According to this configuration, as described in the above-described embodiments, the rigidity and heat resistance of the sheet transfer guide can be enhanced.

Further, by including the filler, even when the surface roughness of the base material increases, the predetermined coat layer is formed on the guide face of the base material, and therefore the surface roughness of the guide face can be smaller than the surface roughness of the base material and the sound of sheet conveyance can be reduced.

Aspect H

In any one of Aspect A through Aspect G, the guide face to which the sheet contacts is curved in shape.

According to this configuration, as described in the above-described embodiments, even when the sheet is slid and guided by the curved guide face on which a contact pressure (a sliding load) of the sheet tends to increase.

Aspect I

In any one of Aspect A through Aspect H, the sheet transfer guide further includes at least one projection partly formed in a width direction perpendicular to the sheet conveying direction and extending in the sheet conveying direction, and the guide face to which the sheet contacts is a top surface of the at least one projection.

According to this configuration, as described in the above-described embodiments, the good sheet conveying performance can be secured and, at the same time, an area forming the coat layer can be reduced.

Aspect J

An image forming apparatus of Aspect J includes a sheet transfer guide and an image forming device. The sheet transfer guide includes the sheet transfer guide according to any one of Aspect A through Aspect I. The sheet transfer guide is disposed along a sheet conveyance passage through which a sheet passes and is configured to guide the sheet. The image forming device is configured to form an image on a surface of the sheet.

According to this configuration, as described in the above-described embodiments, the sound of sheet conveyance can be sheet reduced for a long period of time while the sheet that is conveyed in the image forming apparatus is being guided.

Aspect K

In Aspect J, the sheet conveyance passage includes multiple sheet conveyance passages in an apparatus body. The sheet transfer guide according to any one of Aspect A through Aspect I is disposed in a sheet conveyance passage of the multiple sheet conveyance passages. The sheet conveyance passage of the multiple sheet conveyance passages is located in the vicinity of an opening exposed to an outside of the image forming apparatus.

According to this configuration, as described in the above-described embodiments, the sound of sheet conveyance that can leak to the outside of the apparatus body of the image forming apparatus while guiding the sheet being conveyed in the image forming apparatus can be reduced effectively.

Aspect L

An image reading device of Aspect L includes a sheet transfer guide and an image reader. The sheet transfer guide includes the sheet transfer guide according to any one of Aspect A through Aspect I. The sheet transfer guide is disposed along the sheet conveyance passage through which the sheet passes and is configured to guide the sheet having an image. The image reader is configured to read the image formed on the sheet conveyed by the sheet transfer guide.

According to this configuration, as described in the above-described embodiments, the sound of sheet conveyance can be reduced for a long period of time while the sheet such as an original document that is conveyed in the image reading device is being guided.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet transfer guide in a sheet conveyance passage through which a sheet passes, the sheet transfer guide being configured to guide the sheet, the sheet transfer guide comprising:

a base material;

a coat layer formed on the base material and having a surface roughness smaller than a surface roughness of the base material; and a guide face to which the sheet contacts, the coat layer being formed on the guide face.

2. The sheet transfer guide according to claim 1, wherein the coat layer does not move to a surface of the sheet due to contact with the sheet.

3. The sheet transfer guide according to claim 1, wherein the coat layer has a film thickness equal to or less than 50 μm.

4. The sheet transfer guide according to claim 1, wherein the coat layer has a thickness equal to or greater than 20 μm.

5. The sheet transfer guide according to claim 1, wherein the coat layer has a surface roughness equal to or less than 0.2 μm, and wherein the base material has a surface roughness equal to or more than 0.2 μm and equal to or less than 3 μm.

6. The sheet transfer guide according to claim 1, wherein the base material is formed by resin material.

7. The sheet transfer guide according to claim 6, wherein the base material includes at least a resin material and a filler.

8. The sheet transfer guide according to claim 1, wherein the guide face is curved in shape.

9. The sheet transfer guide according to claim 1, further comprising at least one projection partly formed in a width direction perpendicular to a sheet conveying direction and extending in the sheet conveying direction, wherein the guide face to which the sheet contacts is a top surface of the at least one projection.

10. An image forming apparatus comprising:

the sheet transfer guide according to claim 1, in the sheet conveyance passage, the sheet transfer guide configured to guide the sheet; and an image forming device configured to form an image on a surface of the sheet.

11. The image forming apparatus according to claim 10, further comprising multiple sheet conveyance passages in an apparatus body, wherein the sheet transfer guide according to claim 1 is in at least one sheet conveyance passage of the multiple sheet conveyance passages, the at least one sheet conveyance passage of the multiple sheet conveyance passages being located near an opening exposed to an outside of the apparatus body.

12. An image reading device comprising:

the sheet transfer guide according to claim 1, in the sheet conveyance passage through which the sheet passes, the sheet transfer guide configured to guide the sheet, an image being formed on the sheet; and an image reader configured to read the image formed on the sheet conveyed by the sheet transfer guide.

13. The sheet transfer guide according to claim 1, wherein the guide face is a contact face to which one of a leading end of the sheet and a trailing end of the sheet, and at least a part of the sheet other than the leading end and the trailing end contacts.

14. The sheet transfer guide according to claim 1, wherein the guide face is disposed between multiple conveying rollers by which the sheet is conveyed.

* * * * *